US012215478B2

(12) United States Patent
Voutilainen et al.

(10) Patent No.: US 12,215,478 B2
(45) Date of Patent: Feb. 4, 2025

(54) RAM BLOCK ARRANGEMENT AND PILING HAMMER USING ELECTRIC MACHINE

(71) Applicant: Junttan Oy, Kuopio (FI)

(72) Inventors: Tomi Voutilainen, Kuopio (FI); Roni Ryyppö, Helsinki (FI)

(73) Assignee: Junttan Oy, Kuopio (FI)

( * ) Notice: Subject to any disclaimer, the term of this patent is extended or adjusted under 35 U.S.C. 154(b) by 0 days.

(21) Appl. No.: 18/719,389

(22) PCT Filed: Dec. 13, 2022

(86) PCT No.: PCT/FI2022/050829

§ 371 (c)(1),
(2) Date: Jun. 13, 2024

(87) PCT Pub. No.: WO2023/111397

PCT Pub. Date: Jun. 22, 2023

(65) Prior Publication Data

US 2024/0426070 A1 Dec. 26, 2024

(30) Foreign Application Priority Data

Dec. 13, 2021 (FI) ..... 20216269

(51) Int. Cl.
*E02D 7/14* (2006.01)
*E02D 13/04* (2006.01)

(52) U.S. Cl.
CPC ..... *E02D 7/14* (2013.01); *E02D 13/04* (2013.01)

(58) Field of Classification Search
CPC ..... E02D 7/14; E02D 13/04; B25D 11/064; B25D 2217/0019; B25D 2222/54; H02K 41/031; H02K 1/04; H02K 2213/03
See application file for complete search history.

(56) References Cited

U.S. PATENT DOCUMENTS 4,799,557 A * 1/1989 Jacquemet ..... B25D 11/064 173/91
6,201,362 B1 * 3/2001 DeMichelis ..... E02D 7/06 173/91
7,323,798 B2 * 1/2008 Hartramph ..... H02K 11/21 310/68 B
7,633,189 B2 * 12/2009 Iwasa ..... H02K 41/03 310/15
7,823,654 B2 * 11/2010 Kennett ..... E04H 17/263 173/112

FOREIGN PATENT DOCUMENTS

CN 107386286 A 11/2017
CN 108517864 A 9/2018
CN 113073645 A 7/2021
(Continued)

OTHER PUBLICATIONS

PCT International Search Report and Written Opinion, Application No. PCT/FI2022/050829, dated Mar. 17, 2023.

*Primary Examiner* — Nathaniel C Chukwurah
(74) *Attorney, Agent, or Firm* — MacMillan, Sobanski & Todd, LLC

(57) ABSTRACT

There is provided ram block arrangement for a piling hammer (100*a*), comprising: a ram block (104) comprising a frame arrangement (106) for enclosing one or more ram weights therein, wherein the ram block (104) is configured movable by an electric machine (108).

11 Claims, 12 Drawing Sheets

(56) References Cited

FOREIGN PATENT DOCUMENTS

| | | | | |
|---|---|---|---|---|
| EP | 2468961 | A1 | 6/2012 | |
| GB | 2257998 | A | 1/1993 | |
| JP | H04261913 | A | 9/1992 | |
| RU | 2630026 | C1 | 9/2017 | |
| WO | WO-2020058565 | A1 * | 3/2020 | ..... B25D 11/064 |

* cited by examiner

RAM BLOCK ARRANGEMENT AND PILING HAMMER USING ELECTRIC MACHINE

TECHNICAL FIELD

The present invention relates to a ram block arrangement using an electric machine for moving a ram block and a piling hammer.

BACKGROUND

This section is intended to provide a background or context to the invention that is recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

A piling hammer is a machine used in construction work for driving steel, concrete, or wood piles into the earth by a reciprocating movement of a hammer block, or a ram block, that is used for striking the piles. The ram block may be of modular design, whereby ram weights may be added to the ram block and removed from the ram block as needed for driving the piles at a desired striking frequency and energy.

It is known that in the field of piling operating machines, the hammer used for driving piles generally is of the hydraulic type. The main drawbacks of this solution are low energy efficiency that is around 70%, and the presence of hydraulic oil with all the disposal and pollution problems related to the same. Moreover, the speed of the striking hammer may at most be a little higher than that in free fall and thus, the energy that may be transferred with this type of hammers is limited and very heavy striking hammers are required for large sized piles. The effectiveness is further reduced in case of tilted processing since the force of gravity does not act in the same direction in which the striking hammer moves.

SUMMARY

The scope of protection sought for various embodiments of the invention is set out by the independent claims. The embodiments, examples and features, if any, described in this specification that do not fall under the scope of the independent claims are to be interpreted as examples useful for understanding various embodiments of the invention.

BRIEF DESCRIPTION OF THE DRAWINGS

For a more complete understanding of the example embodiments, reference is now made to the following descriptions taken in connection with the accompanying drawings in which.

DETAILED DESCRIPTION OF SOME EXAMPLE EMBODIMENTS

Figure 1A:
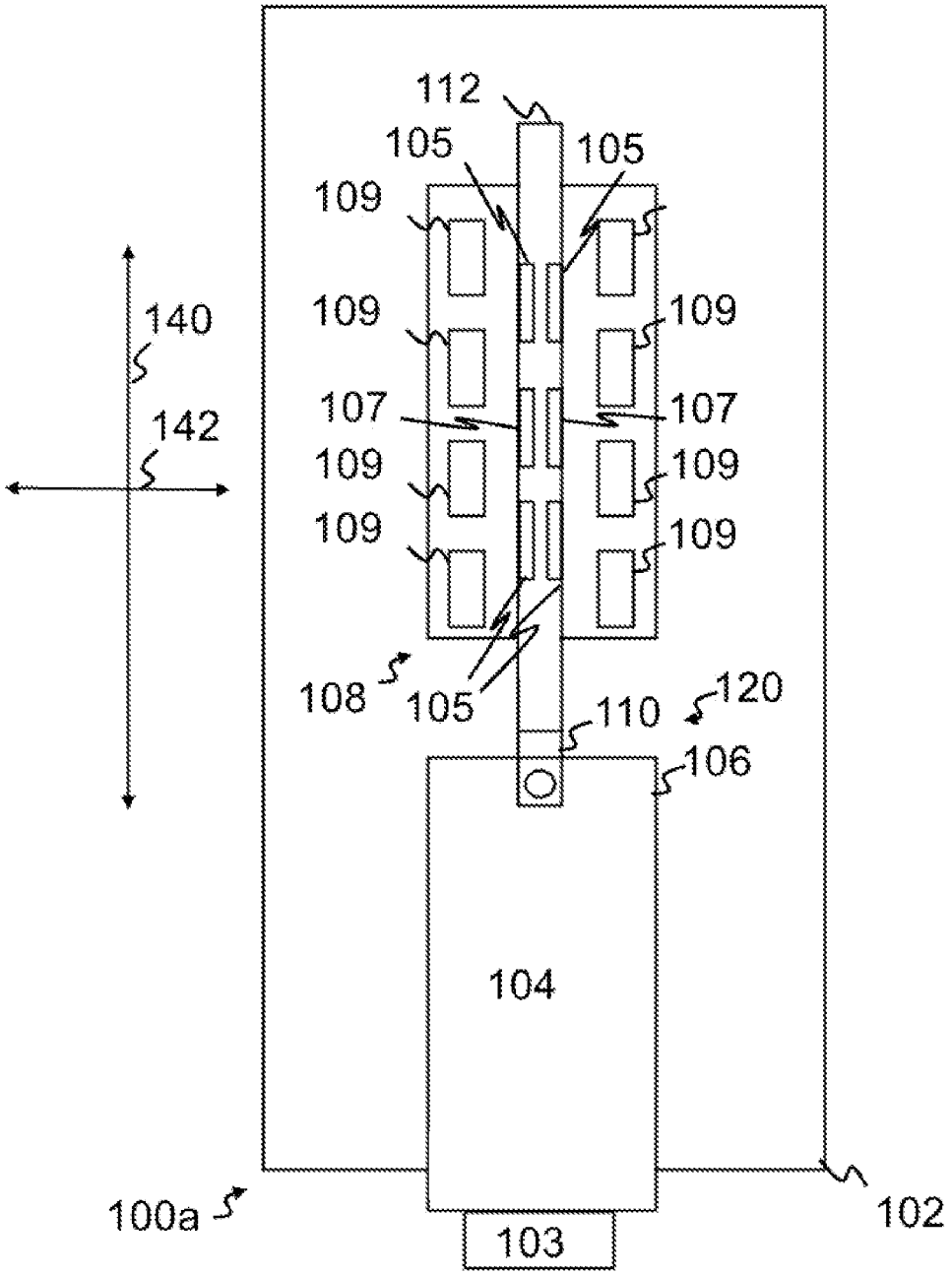
FIGS. 1*a*, 1*b* and 2 illustrate examples of piling hammers in accordance with at least some embodiments.

Use of ordinal terms such as "first," "second," "third," etc., in the claims and description to modify a described feature does not by itself connote any priority, precedence, or order of one described feature over another or the temporal order in which acts of a method are performed, but are used merely as labels to distinguish one described feature having a certain name from another described feature having a same name (but for use of the ordinal term) to distinguish the described feature.

The verbs "to comprise" and "to include" are used in this document as open limitations that neither exclude nor require the existence of un-recited features. The features recited in dependent claims are mutually freely combinable unless otherwise explicitly stated. Furthermore, it is to be understood that the use of "a" or "an", i.e. a singular form, throughout this document does not exclude a plurality.

In this document, the word "geometric" when used as a prefix means a geometric concept that is not necessarily a part of any physical object. The geometric concept can be for example a geometric point, a straight or curved geometric line, a geometric plane, a non-planar geometric surface, a geometric space, or any other geometric entity that is zero, one, two, or three dimensional.

There is provided ram block arrangements and piling hammers for moving a ram block by an electric machine. The electric machine may generate a magnetic force that is employed for moving the ram block. On the other hand torque of the electric machine may be transformed into linear movement that is communicated to the ram block. The ram block may comprise a frame arrangement for enclosing one or more ram weights therein. The ram block may be configured movable by a magnetic force generated by a linear electric machine (LEM) or by the linear movement transformed from torque of the electric machine. In this way the ram block may be used for driving piles without a hydraulic system for moving the ram block, whereby energy efficiency of piling may be improved. Since the piles are driven without a hydraulic system, also the drawbacks of hydraulic systems are avoided. One approach for configuring the ram block movable by a magnetic force is to provide a connector that enables the ram block to be connected to the linear electric machine. According to this approach the connector is configured to connect the ram block to a mover of the linear electric machine. Thanks to the mover being connected directly to the ram block by the connector, power of the linear electric machine is coupled directly without intermediary gear or transmission to the ram block, whereby a linear movement of the mover may be directly coupled to the ram block. In this way power of the linear electric machine may be efficiently transferred to a movement of the ram block for striking the pile. It should be noted that since there is no need for gears or transmission between the linear electric machine and the ram block, downtime due to service need of such gears or transmission may be avoided which supports operational efficiency of the piling hammer. Another approach for configuring the ram block movable by a magnetic force is to adapt a frame arrangement of the ram block such that the ram block itself can form a part, e.g. a mover, of the linear electric machine. According to this approach the frame arrangement comprises permanent magnets provided one after another in a striking direction of the piling hammer and the frame arrangement is configured movable at least partly inside the linear electric machine. In this approach a need for a connector between the ram block and a mover of the linear electric machine has been eliminated. The resulting piling hammer has a compact structure since the ram block forms a part of the linear electric machine. Accordingly, designing piling hammers based on this approach makes it possible to at least partially decrease the length of the piling hammer compared with the first approach, where the linear electric machine is separated from the ram block by the connector. In an approach for configuring the ram block movable by the linear movement transformed from torque of the electric machine, there is provided an eccentric drive unit that is connected to an output shaft of the electric machine for receiving torque of the electric machine. The rotational movement of the output shaft is transformed into a linear movement, e.g. a movement in a striking direction of the piling hammer, by the eccentric drive unit. A mover is connected to the eccentric drive unit to be linearly movable based on the received torque. The mover is connected to a connector at the ram block, whereby the ram block may be moved by the mover for striking the pile. In this way power of the electric machine is coupled to the ram block.

In an example for understanding the approaches, it should be appreciated that a linear electric machine may comprise a mover comprising an active part containing permanent magnets provided one after another in the longitudinal direction of the linear electric machine, a stator comprising a ferromagnetic core-structure and windings for conducting electric currents. When electric currents are supplied to the windings, a magnetic force acting on the mover is generated, whereby the mover may be moved along a linear path of movement, e.g. back and forth. The mover may be an elongated part that is moved by the magnetic force in a longitudinal direction of the mover.

In another example for understanding the approaches, it should be appreciated that instead of a linear electric machine, also an electric machine having an output shaft for providing a torque as output may be utilized for moving a mover along a linear path of movement. An eccentric drive unit that may be connected to an output shaft of the electric machine for receiving torque and an eccentric drive unit may be connected to the output shaft for transforming the torque into a linear movement. The mover may be connected to the eccentric drive unit, whereby the mover may be moved along the linear path of movement.

In a further example for understanding the approaches, it should be appreciated that the linear electric machine may comprise first and second support structures on both sides of the ferromagnetic core structure of the stator in the longitudinal direction of the mover, the first and second support structures supporting the mover to be linearly movable with respect to the stator in the longitudinal direction of the linear electric machine.

In a further example for understanding the approaches, it should be appreciated that the above-mentioned active part of the mover may be longer than the ferromagnetic core-structure of the stator in the longitudinal direction of the linear electric machine, and the first support structure may comprise a frame-portion made of solid metal, e.g. solid steel. The first support structure may further comprise a support element arranged to keep the mover a distance away from the solid metal of the frame-portion and comprising a sliding surface being against the mover. The support element may comprise material whose electrical conductivity, S/m, is less than that of the solid metal of the frame-portion, e.g. at most half of the electrical conductivity of the solid metal. The support element may be tubular and arranged to surround an end-portion of the mover, the end-portion surrounded by the support element comprising an end-surface of the mover. As the mover is kept the above-mentioned distance away from the solid metal of the frame-portion of the first support structure, eddy currents induced by the permanent magnets of the mover to the solid metal are reduced. Therefore, losses of the linear electric machine are reduced and thereby the efficiency of the linear electric machine is improved.

In a further example for understanding the approaches, it should be appreciated that the linear electric machine can be, for example but not necessarily, a tubular linear electric machine where the ferromagnetic core-structure of the stator is arranged to surround the mover and the windings of the stator are arranged to surround the mover and conduct electric currents in a circumferential direction.

In a further example for understanding the approaches, it should be appreciated that the linear electric machine, or electric machine, may be an electric motor, such as a synchronous motor, such as a flux switching permanent magnet synchronous machine (FSPMSM), or an induction motor.

Figure 1B:
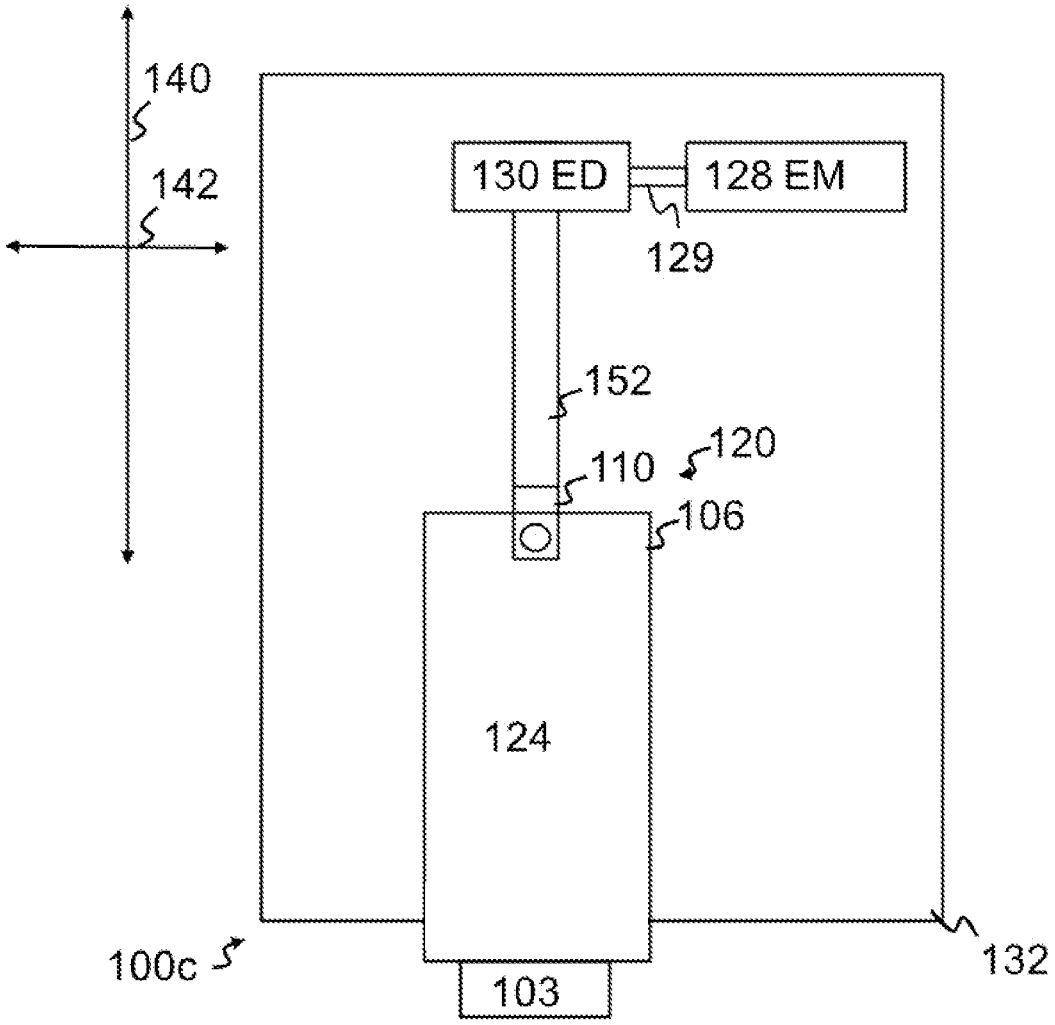
Figure 2:
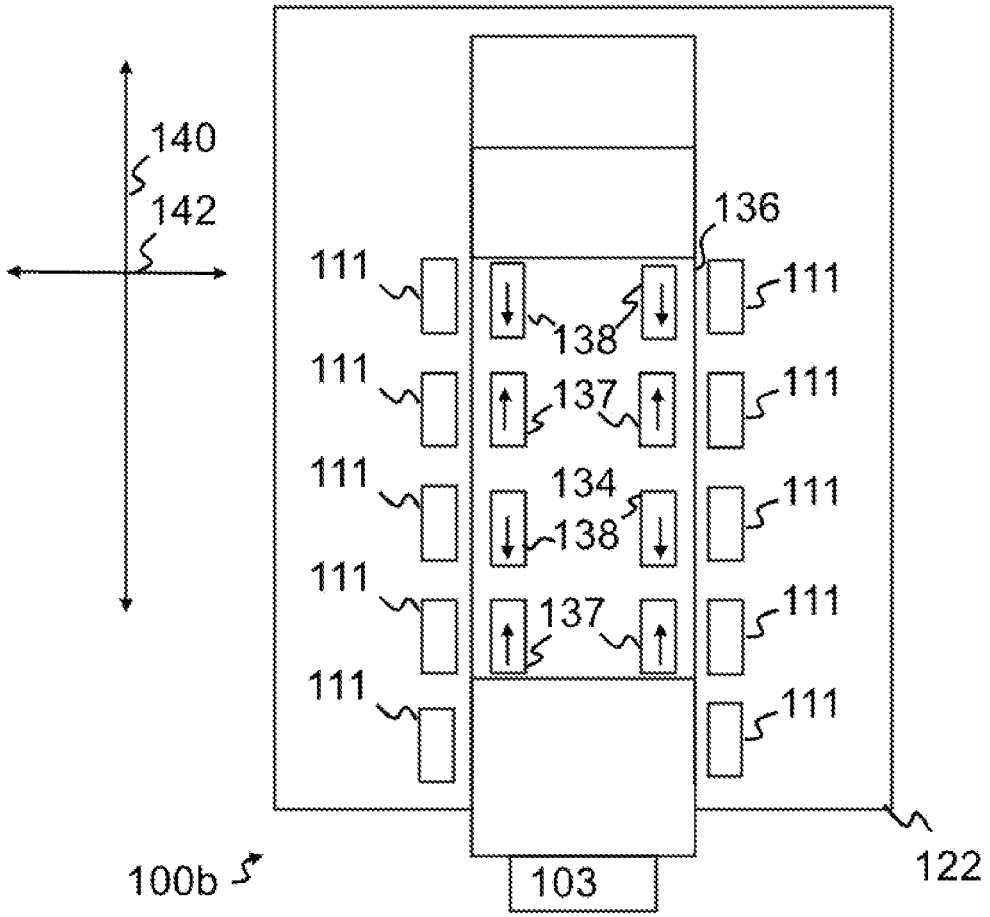

FIGS. 1*a*, 1*b* and 2 illustrate examples of piling hammers in accordance with at least some embodiments. The piling hammers are illustrated with the help of a striking direction 140 of the piling hammer and a transverse direction 142 of the striking direction. Transverse direction of the striking direction may be also referred to a radial direction of a mover 112 of a linear electric machine 108, or an axial direction of a rotatable output shaft 129 of an electric machine 128. In the illustrated examples, the linear electric machine is an induction motor, but it should be noted that the linear electric machine 108 and the electric machine 128 may also be a synchronous motors, e.g. FSPMSM. Each of the piling hammers comprise a frame 102,122,132 a drive cap 103 attached to the frame and a ram block 104, 134, 124. In order to drive a pile to the ground the ram block is moved reciprocally in the striking direction, e.g. repeatedly up and down. Accordingly, the ram block has along the striking direction one or more upper positions and a lower position at the drive cap. A single blow may start at an upper position, where the ram block has potential energy. In order to drive the pile, the ram block is accelerated from the upper position to the lower position, where the potential energy is transformed into kinetic energy and the ram block strikes the drive cap. The energy from the blow to the drive cap is transferred by the drive cap to the pile for driving the pile deeper into the ground. After the blow, the ram block is returned an upper position for a subsequent blow.

The piling hammers 100*a*, 100*b*, 100*c* comprise ram block arrangements that comprise ram blocks 104, 134, 124, that comprise frame arrangements 106,136 for enclosing one or more ram weights therein. The ram blocks 104, 134,124 are configured movable by electric motors. The ram blocks 104,134 are configured movable by a magnetic force generated by the linear electric machine 108 and the ram block 124 is configured movable by torque from the output shaft 129 of the electric machine 128. Using the linear electric machine and the torque of the electric machine 128 to move the ram blocks 104, 134,124 provides overcoming the drawbacks of the hydraulic piling hammers. The electric machines provide that the acceleration of the ram blocks 104, 134,124 when hitting a pile may be increased compared with hydraulic hammers which is particularly advantageous for tilted processing where less potential energy is converted to kinetic energy.

In FIG. 1*a* the piling hammer 100*a* comprises a linear electric machine 108 connected to the ram block 104 of the ram block arrangement. In this way the ram block may be linearly moved by the linear electric machine for driving piles. In an example, the linear electric machine comprises a mover 112 that is connected to the ram block. A magnetic force generated by a stator of the linear electric machine may be directed to the mover 112 for causing linear movement of the mover 112 and the connected ram block. It should be noted that range of linear movement of the mover should be maintained within a range of a magnetic force from the stator for controlling the movement. In an example, the linear electric machine 108 comprises permanent magnets 107,105 provided one after another in a striking direction 140 of the piling hammer 100*a* and a stator comprising windings 109 for directing a magnetic force to the mover.

In an example in accordance with at least some embodiments the ram block arrangement of the piling hammer 100*a* comprises a connector 110 configured to connect the ram block 104 to the mover 112 of the linear electric machine 108. It should be noted that the connector 110 may be connected to the frame arrangement 106 at a position, where the mover 112, the ram block and the connector 110 are aligned in the striking direction 140 of the piling hammer. For example, the mover, the ram block and the connector 110 are aligned, when they are positioned on a common axis. The common axis may extend along longitudinal directions of each of the mover, the ram block and the connector.

In an example in accordance with at least some embodiments, the connector 110 comprises a collar portion 114 adapted to a diameter 117 of the mover 112 for connecting the collar portion around a circumference of the mover. In this way the magnetic force directed to the mover may be transformed into a movement of the ram block 104 via the collar portion connected to the mover. It should be noted that the collar portion may be designed to have a contact surface of a sufficient size with the mover for achieving a desired connecting force with the mover. Therefore, the diameter 117 of the mover at an end of the mover facing the ram block may be kept relatively small, while securely connecting to the ram block via the collar portion connected at the circumferential surface. It should be noted that since the collar portion is connected to the mover at the circumferential surface, the collar portion may leave the end of the mover facing the ram block substantially uncovered and visible, when the collar portion is connected to the mover. This allows inspecting a condition of the end surface without removing the collar portion. In an example, the collar portion may be connected around the circumference of the mover by a threading. In an example of the threading, the collar portion may have an inside thread and the mover may have an outside thread. In an example, the collar portion may have a shape that provides that the collar portion may be placed around the circumference of the mover. The shape may be circular, e.g. a ring-like shape.

It should be noted that the diameter 117 and shape of the mover 112 may be significantly determined based on the linear electric machine 108. For example, the diameter of the mover, e.g. at the end of the mover facing the ram block 104, may be a cross-sectional diameter in a transverse direction to the longitudinal direction of the mover. The shape of the mover may be an elongated shape having a circular, or ring-like, cross-section. The diameter and shape may be defined based on a diameter and shape of a passage through the stator of the linear electric machine. The passage provides that the mover may reciprocate along a linear path between positions. In one of the positions, a larger portion of the mover is inside of the linear electric machine and in another position a smaller portion of the mover is inside the linear electric machine. The diameter and shape of the passage and the diameter and shape of the mover are preferably made to match to allow movement of the mover in the striking direction 140 and for efficient transfer of the magnetic force from the stator to the mover in different positions of the mover.

In FIG. 1*b* the piling hammer 100*c* comprises an electric machine 128 comprising a rotatable output shaft 129 for output of torque. The electric machine 128 is operatively connected to a ram block 124 of the ram block arrangement by an eccentric drive unit 130. The eccentric drive unit 130 is connected to the output shaft of the electric machine 128 and to a mover 152 for transforming torque from the output shaft into a linear movement of the mover. The ram block arrangement of the piling hammer 100*c* comprises a connector 110 configured to connect the ram block 124 to the mover 152 of the electric machine 128. In this way torque from the output shaft may be transformed into linear movement of the mover for striking the pile. Accordingly, Similar to FIG. 1*a* also in FIG. 1*b*, the mover 152 may be an elongated part that is moved by the electric machine. The mover 152 may be similar to the mover 112, however, it should be noted that at least part of the features described with the mover 112 may be omitted. For example, the permanent magnets 105, 107 may be omitted for the mover 152. Also, it should be noted that the mover 152 may be shorter than the mover 112, since the mover 152 is not inside the electric machine 128.

In an example the eccentric drive unit 130 is configured to be connected to the output shaft of the electric machine 128 and to the mover 152 and to transform torque from the output shaft into a linear movement of the mover. One end of the mover may be connected to the connector and another end, i.e. opposite end, to the mover is connected to the eccentric drive unit 130.

In FIG. 2, the piling hammer 100*b* comprises a frame 122 housing the ram block arrangement. The frame 122 comprises windings 111 for producing a magnetic force directed to the ram block 134 in response to electric current supplied to the windings. The magnetic force may be controlled for causing a linear movement of the ram block 134 in the striking direction 140 of the piling hammer 100*b*. Accordingly, the frame 122 of the piling hammer 100*b* is configured to serve as a stator of the linear electric machine and the ram block 134 of the piling hammer 100*b* is configured to serve as a mover of the linear electric machine.

In an example in accordance with at least some embodiments, the frame arrangement 136 comprises permanent magnets 137,138 provided one after another in a striking direction 140 of the piling hammer 100*b*. In this way the ram block 134 may serve for a mover of the linear electric machine. It should be noted that range of linear movement of the mover should be maintained within a range of a magnetic force from the stator for controlling the movement.

In an example in accordance with at least some embodiments, neighboring permanent magnets 137,138 in the striking direction 140 have opposite magnetization directions. The opposite magnetization directions are illustrated by arrows on the permanent magnets. In this way, when the mover is subjected to the magnetic force from the stator, the linear movement of the ram block 134 in the striking direction may be facilitated. The magnetization directions of the permanent magnets may be e.g. parallel to the striking direction 140.

In an example in accordance with at least some embodiments, the frame arrangement 136 comprises ferromagnetic core-elements that are alternately with the permanent magnets 137,138 in the striking direction 140 of the piling hammer 100*b*. In this way magnetic field density between the permanent magnets may be supported.

Figure 3:
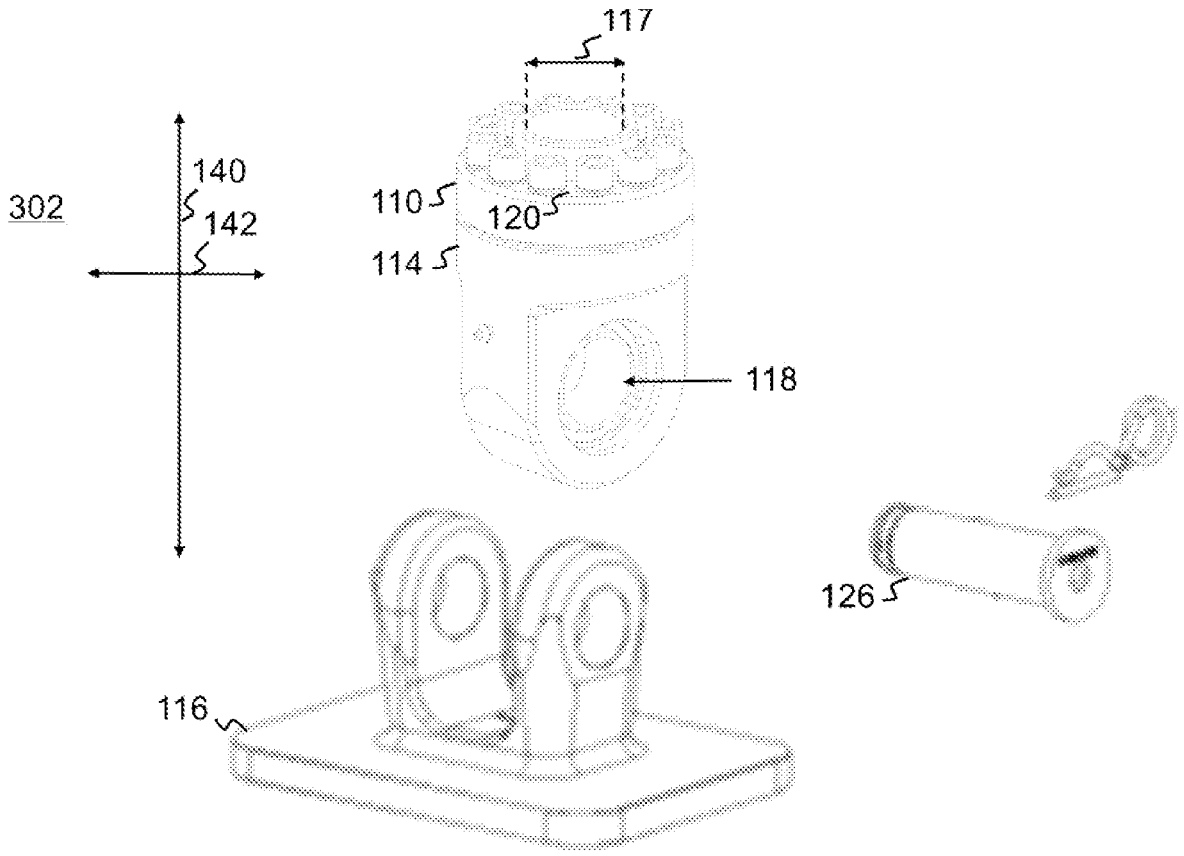
FIG. 3 illustrates an example of a connector configured to connect to a mover in accordance with at least some embodiments.

FIG. 3 illustrates an example of a connector configured to connect to a mover of an electric machine in accordance with at least some embodiments. The connector 302 may be used for the connector 110 in FIG. 1 and is described with reference to the items described with FIG. 1. The connector 302 has a base portion 116 configured to connect with the frame arrangement 106 and an intermediate portion 118 for connecting the collar portion 114 and the base portion 116 together.

The base portion provides adaptation of the ram block 104 to the intermediate portion and the collar portion provides adaptation of the mover 112 to the intermediate portion, whereby in the event of a breakage of either the base portion or the collar portion it may be sufficient to service only the one that is broken without disconnecting the one that is not broken. It should be noted that in the illustrated example the intermediate portion and is shown as connected to the collar portion.

In an example, the collar portion 114 may comprise a flange 120 for connecting with the intermediate portion 118. The flange provides that the collar portion may be attached by the flange to the intermediate portion positioned towards the ram block 104 in the striking direction 140. In an example, the flange may extend in the transverse direction 142.

In an example in accordance with at least some embodiments, the base portion 116 comprises a lifting lug and the intermediate portion 118 comprises a lifting eye connectable with the lifting lug by a pin 126. The lifting lug and lifting eye provide that the connection between the ram block 104 and the mover can be quickly secured by placing the pin through the lifting eyer and lifting lug, or quickly released by removing the pin.

In an example according to at least some embodiments, the ram block 104,134 is a modular ram block. The modular ram block is configured to support adding and removing one or more ram modules for adapting weight of the ram block. Adapting the weight of the ram block provides that energy for striking piles from potential energy of the ram block may be adapted. A low number of ram modules may have a relatively low weight, whereby a contribution of the linear electric machine to a total energy for striking a pile may be larger than if a higher number of ram modules, and a relatively high weight of the ram block, is used for striking the pile.

Examples in accordance with at least embodiments described with reference to FIGS. 4*a*-4*c*, 5 and 6 refer to a linear electric machine 400 that may be used in the piling hammers 100*a* described with FIG. 1. However, it should be noted that the linear electric machine 400 described with reference to FIGS. 4*a*-4*c*, 5 and 6 may also be applied to the linear electric machine described with FIG. 2, where the linear electric machine is formed by the ram block 134 serving as a mover and the frame 122 serving as a stator of the linear electric machine.

Figure 4A:
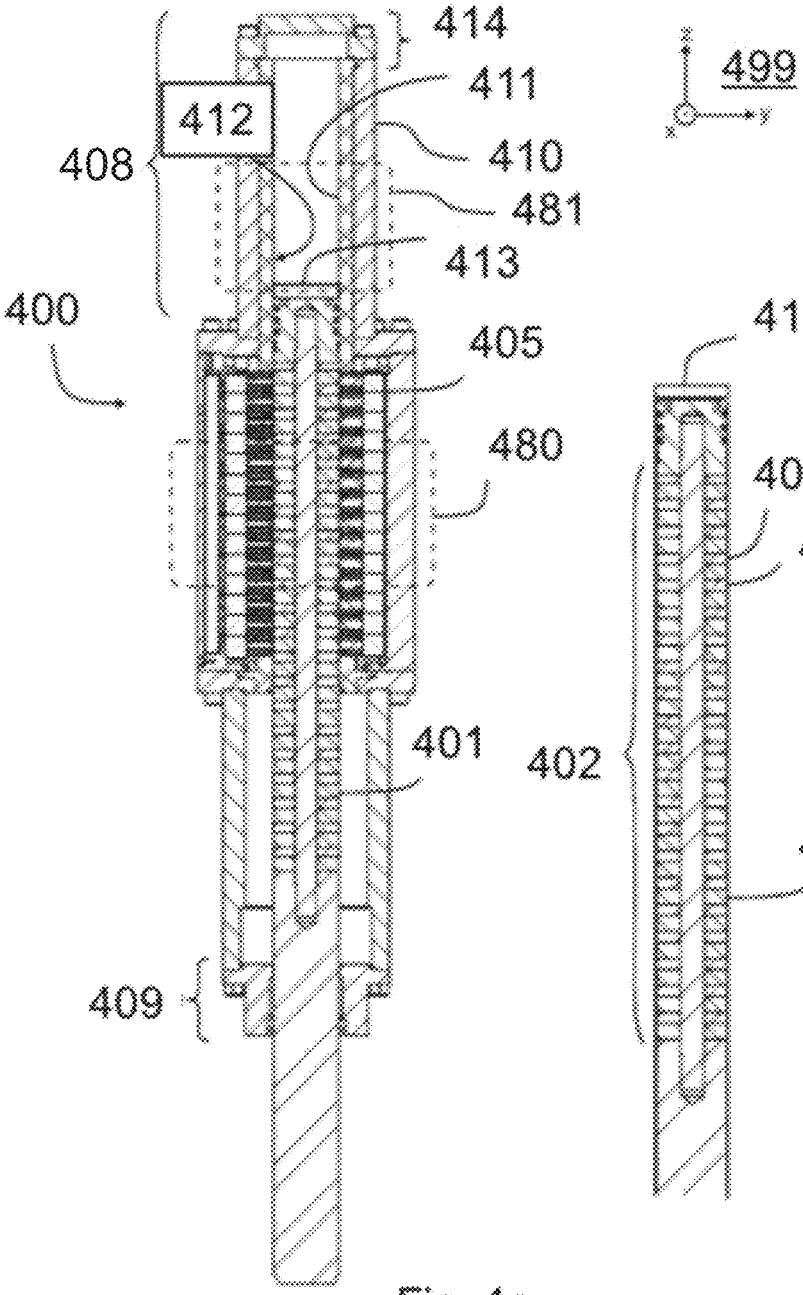
FIGS. 4*a*, 4*b*, and 4*c* illustrate an example of a linear electric machine according to at least some embodiments.
Figure 4A:
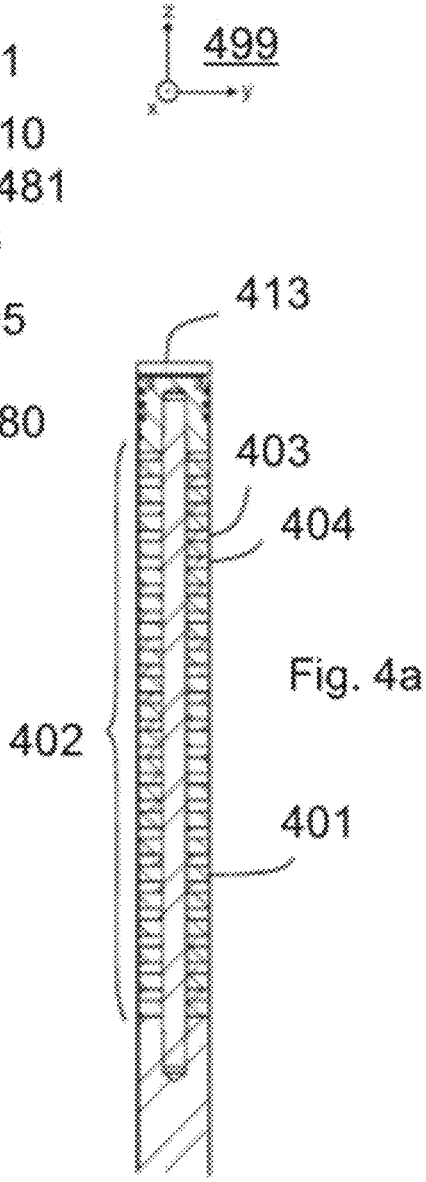
Figure 4B:
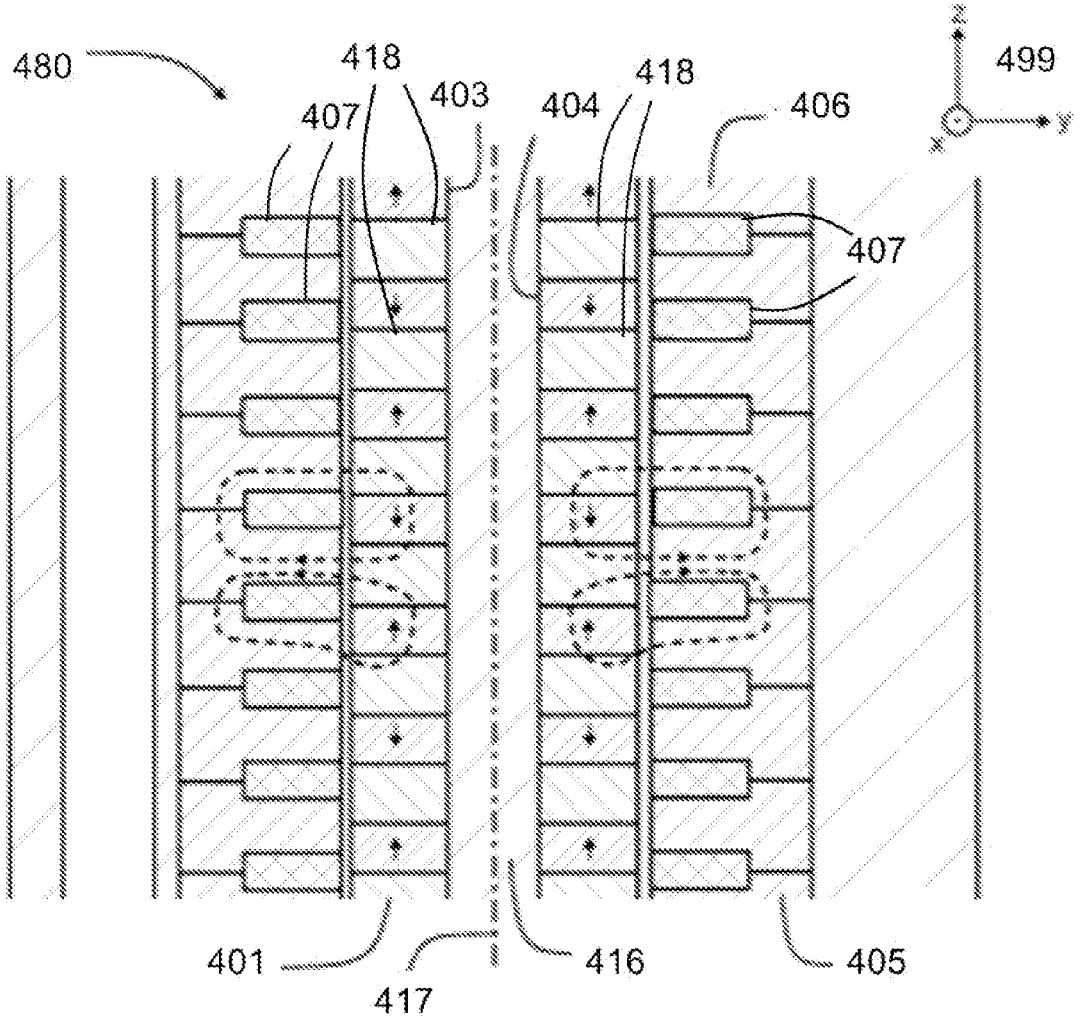
Figure 4C:
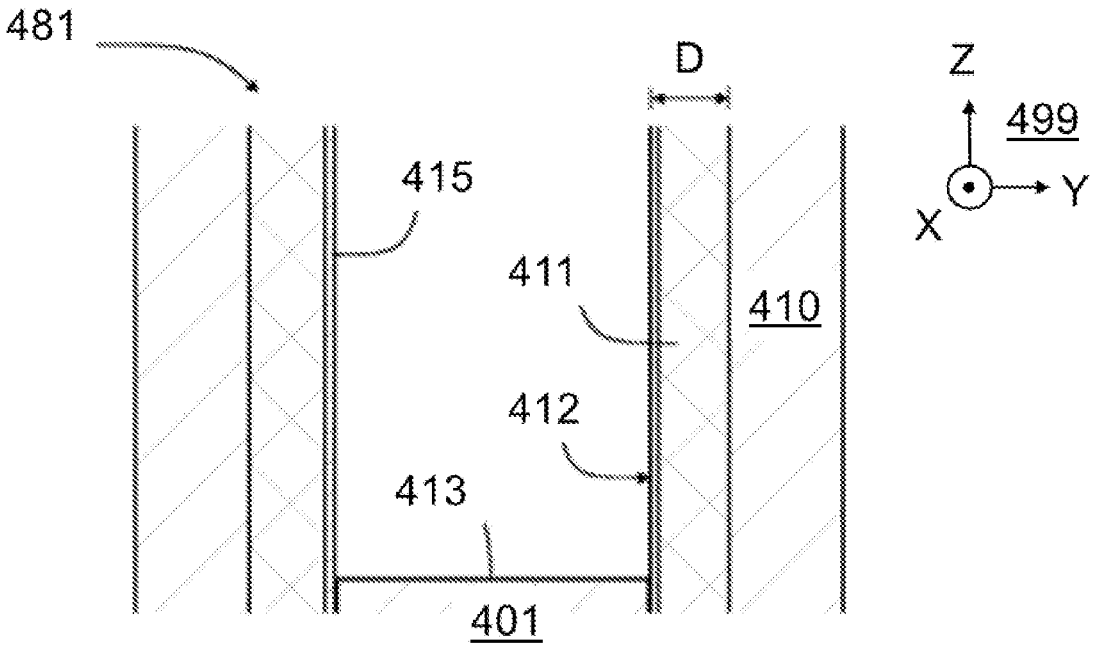

FIG. 4*a* shows a section view of the linear electric machine 400 according to an exemplifying and non-limiting embodiment. The section plane is parallel with the yz-plane of a coordinate system 499 comprising x, z, and y axes. FIG. 4*b* shows a magnification of a part 480 of FIG. 4*a*, and FIG. 4*c* shows a magnification of a part 481 of FIG. 4*a*. The linear electric machine comprises a mover 401 and a stator 405. FIG. 4*a* shows a part of the mover 401 also separately for the sake of clarity. The mover 401 comprises an active part 402 that contains permanent magnets provided one after another in the longitudinal direction of the linear electric machine. The longitudinal direction is parallel with the z-axis of the coordinate system 499. In FIGS. 4*a* and 4*b*, two of the permanent magnets are denoted with references 403 and 404.

The stator 405 comprises a ferromagnetic core-structure and windings for generating magnetic force acting on the mover 401 in response to supplying electric currents to the windings. In FIG. 4*b*, the ferromagnetic core-structure of the stator is denoted with a reference 406 and cross-sections of two coils of the windings are denoted with a reference 407. As shown in FIG. 4*b*, the ferromagnetic core-structure 406 constitutes stator slots for the coils of the windings. Typically, the windings are arranged to constitute a multi-phase winding, e.g. a three-phase winding, and the windings can be implemented for example so that each stator slot contains only one coil which belongs to one phase of the windings. It is, however, also possible that each stator slot contains for example two coils which can belong to different phases of the windings or to a same phase of the windings. The linear electric machine 400 comprises first and second support structures 408 and 409 on both sides of the ferromagnetic core-structure of the stator in the longitudinal direction of the linear electric machine. The first and second support structures 408 and 409 are arranged to support the mover 401 to be linearly movable with respect to the stator 405 in the longitudinal direction of the linear electric machine. As shown in FIG. 4*a*, the active part 402 of the mover 401 is longer than the ferromagnetic core-structure of the stator 405 in the longitudinal direction of the linear electric machine. Thus, during a reciprocating linear movement of the mover 401, some of the permanent magnets of the mover 401 are temporarily inside a frame-portion 410 of the support structure 408. The frame-portion 410 is made of solid metal, e.g. solid steel, to achieve a sufficient mechanical strength. The support structure 408 further comprises a support element 411 arranged to keep the mover 401 a distance away from the solid metal of the frame-portion 410.

In FIG. 4*c*, the above-mentioned distance is denoted with D. The support element 411 constitutes a sliding surface 412 that is against the mover and supports the mover 401 in transversal directions, i.e. in directions perpendicular to the longitudinal direction of the linear electric machine. The support element 411 comprises material whose electrical conductivity, S/m, is less than that of the solid metal of the frame-portion 410. The electrical conductivity of the material of the support element 411 can be e.g. less than 50%, 40%, 30%, 20%, 10%, or 5% of the electrical conductivity of the solid metal of the frame-portion 410. As the mover 401 is kept the distance D away from the solid metal of the frame-portion 410, eddy currents induced by the moving permanent magnets of the mover to the solid metal are reduced. As a corollary, losses of the linear electric machine are reduced and thereby the efficiency of the linear electric machine is improved. The distance D can be e.g. at least 5 mm, at least 10 mm, at least 15 mm, at least 20 mm, at least 25 mm, or at least 30 mm.

The support element 411 may comprise for example polymer material or some other suitable material having low electrical conductivity and suitable mechanical properties.

The polymer material can be e.g. polytetrafluoroethylene, known as Teflon. In a linear electric machine according to an exemplifying and non-limiting embodiment, the support element 411 comprises a coating constituting the sliding surface that is against the mover 401. In FIG. 4*c*, the coating is denoted with a reference 415. The coating improves the wear resistance of the sliding surface of the support element 411. The coating can be for example a layer of chrome. In cases, where the coating is made of electrically conductive material, the coating is advantageously thin to reduce eddy current losses in the coating. In FIG. 4*c*, the thickness of the coating 415 is exaggerated for the sake of clarity.

The exemplifying linear electric machine illustrated in FIGS. 4*a*-4*c* is a tubular linear electric machine where the ferromagnetic core-structure 406 of the stator 405 is arranged to surround the mover 401 and the windings 407 of the stator are arranged to surround the mover 401 and conduct electric currents in a circumferential direction. The mover 401 can be, for example but not necessarily, substantially rotationally symmetric with respect to a geometric line 417 shown in FIG. 4*b*. The mover 401 comprises ferromagnetic core-elements that are alternately with the permanent magnets in the longitudinal direction of the mover. In FIG. 4*b*, two of the ferromagnetic core-elements of the mover 401 are denoted with a reference 418. In this exemplifying case, the magnetization directions of the permanent magnets of the mover 401 are parallel with the longitudinal direction, and longitudinally neighboring ones of the permanent magnets have magnetization directions opposite to each other. In FIG. 4*b*, the magnetization directions of the permanent magnets are depicted with arrows. Exemplifying magnetic flux lines are denoted with curved dashed lines. In this exemplifying case, the mover 401 comprises a center rod 416 that mechanically supports the permanent magnets and the ferromagnetic core-elements of the mover. The center rod 416 is advantageously made of non-ferromagnetic material in order that as much as possible of the magnetic fluxes generated by the permanent magnets of the mover 401 would flow via the stator 405. The center rod 416 can be made of for example austenitic steel or some other sufficiently strong non-ferromagnetic material.

It should be noted that, the configuration of the active part 402 and the stator, e.g. in terms of a number of ferromagnetic core elements, a number of permanent magnets and a number of windings and a length of the active part, may adapted according to implementation so as to accelerate a ram block from an upper position to a lower position, where potential energy is transformed into kinetic energy and the ram block strikes a drive cap.

In the exemplifying linear electric machine illustrated in FIGS. 4*a*-4*c*, the support element 411 is tubular and arranged to surround an end-portion 413 of the mover 401. An end-portion 414 of the support structure 408 may be closed.

Figure 5:
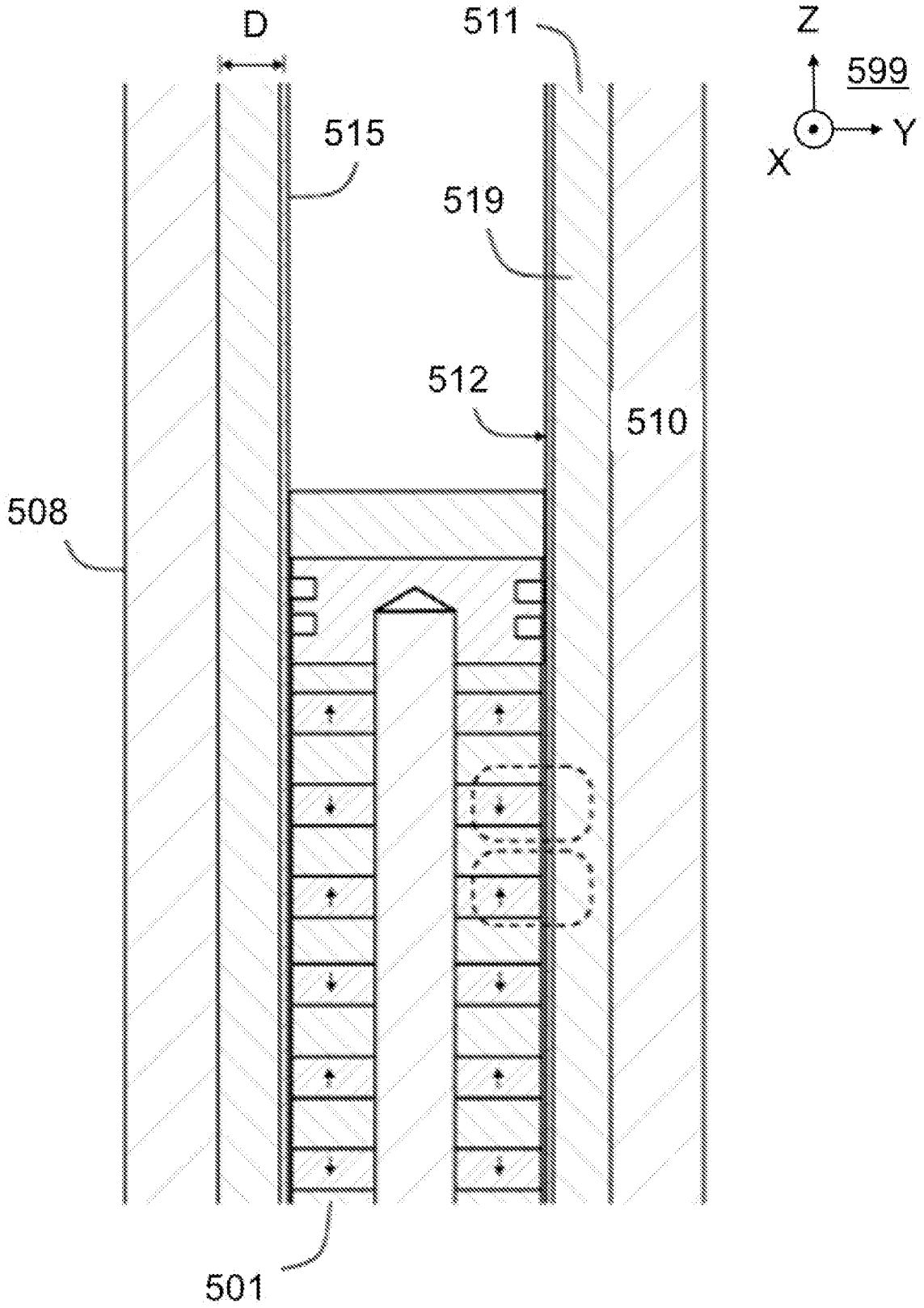
FIG. 5 illustrates an example of a detail of a linear electric machine according to at least some embodiments.

FIG. 5 shows a section view of a part of a linear electric machine according to an exemplifying and non-limiting embodiment. The part is described with reference to items described with FIGS. 4*a*-4*c*. The section plane is parallel with the yz-plane of a coordinate system 599 comprising x, z, and y axes. FIG. 5 illustrates a part of a support structure 508 of the linear electric machine and a part of a mover 501 of the linear electric machine. The support structure 508 is arranged to support the mover 501 in the same way as the support structure 408 is arranged to support the mover 401 in the linear electric machine 400 illustrated in FIGS. 4*a*-4*c*. The support structure 508 comprises a support element 511 that comprises material whose electrical conductivity is less than that of solid metal constituting a frame-portion 510 of the support structure 508. In this exemplifying linear electric machine, the support element 511 comprises ferromagnetic material 519 whose electrical conductivity is less than that the solid metal constituting the frame-portion 510, e.g. at most half of the electrical conductivity of the solid metal. The ferromagnetic material 519 provides low reluctance paths for magnetic fluxes generated by permanent magnets of the mover 501, and thereby the ferromagnetic material 519 reduces magnetic stray fluxes directed to the frame-portion 510 of the support structure 508. Furthermore, the ferromagnetic material 519 reduces the flux variation taking place in the permanent magnets and thereby the ferromagnetic material reduces losses of the permanent magnets. The ferromagnetic material 519 can be for example ferrite or iron powder composite such as e.g. SOMALOY® Soft Magnetic Composite. The support element 511 further comprises a coating 515 on a surface of the ferromagnetic material and constituting a sliding surface that is against the mover 501. The coating 515 can be for example a layer of chrome.

Figure 6A:
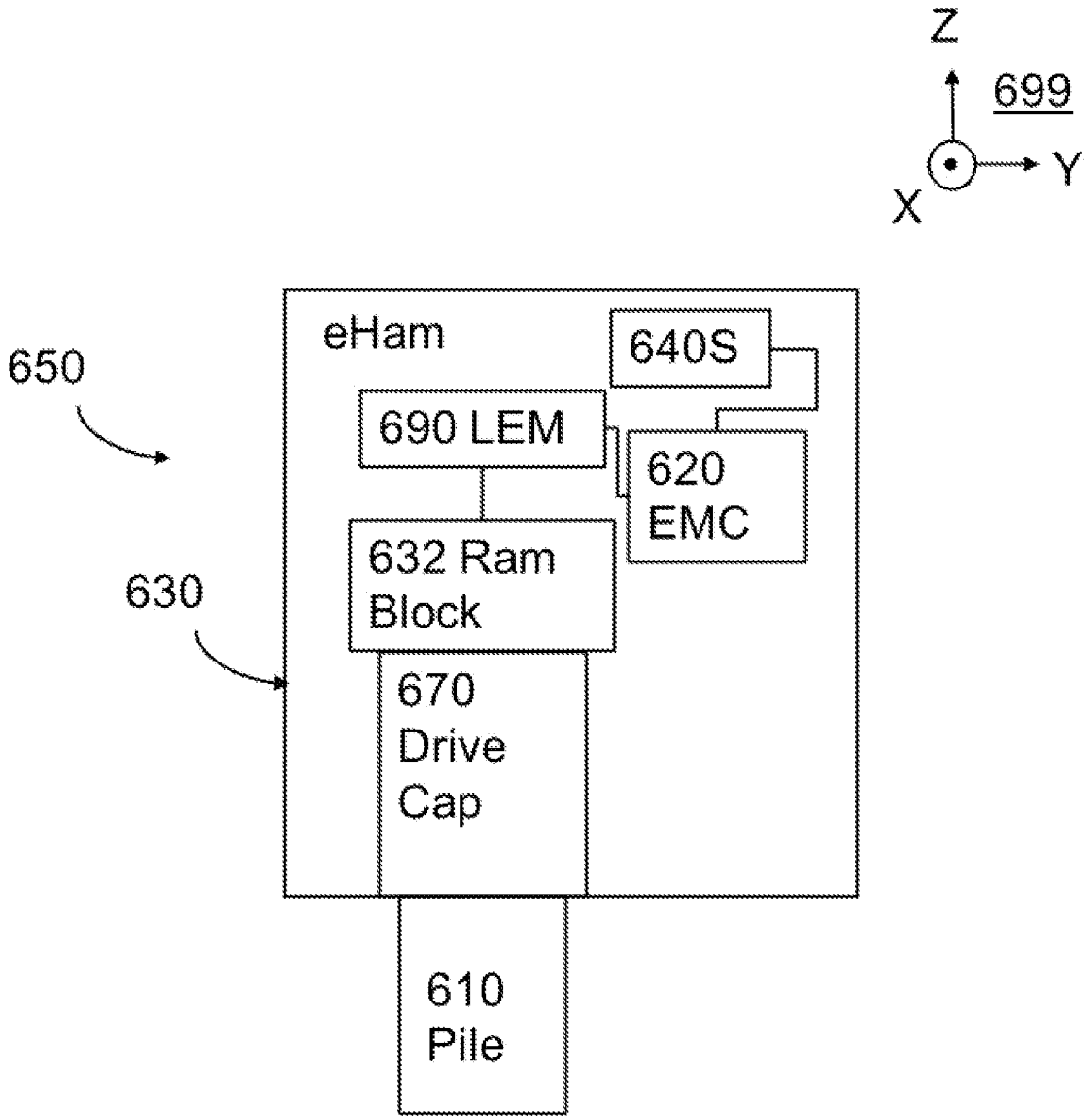
FIGS. 6*a*, 6*b* and 6*c* show examples of block diagrams for hammer devices according to at least embodiments.
Figure 6B:
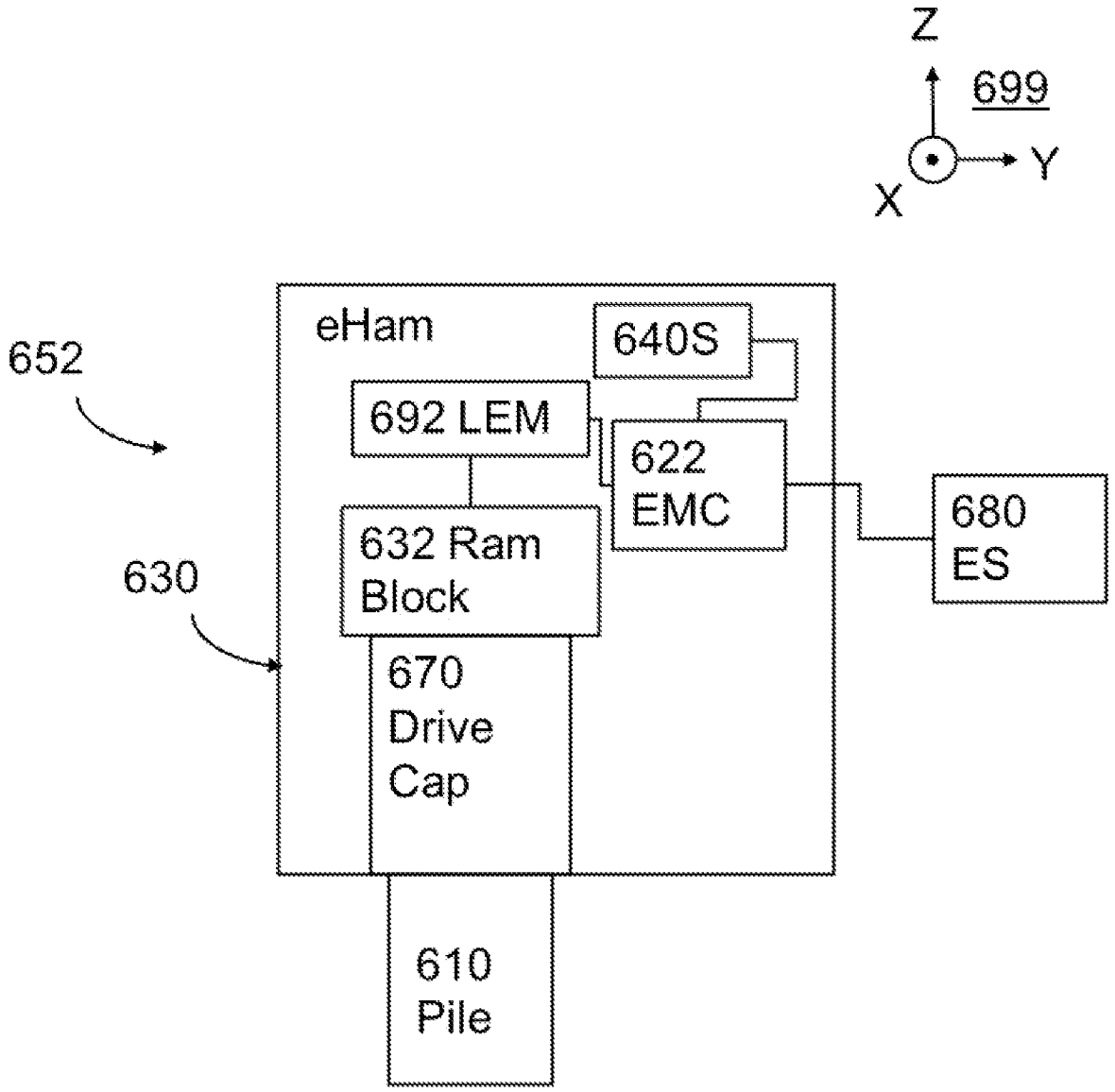
Figure 6C:
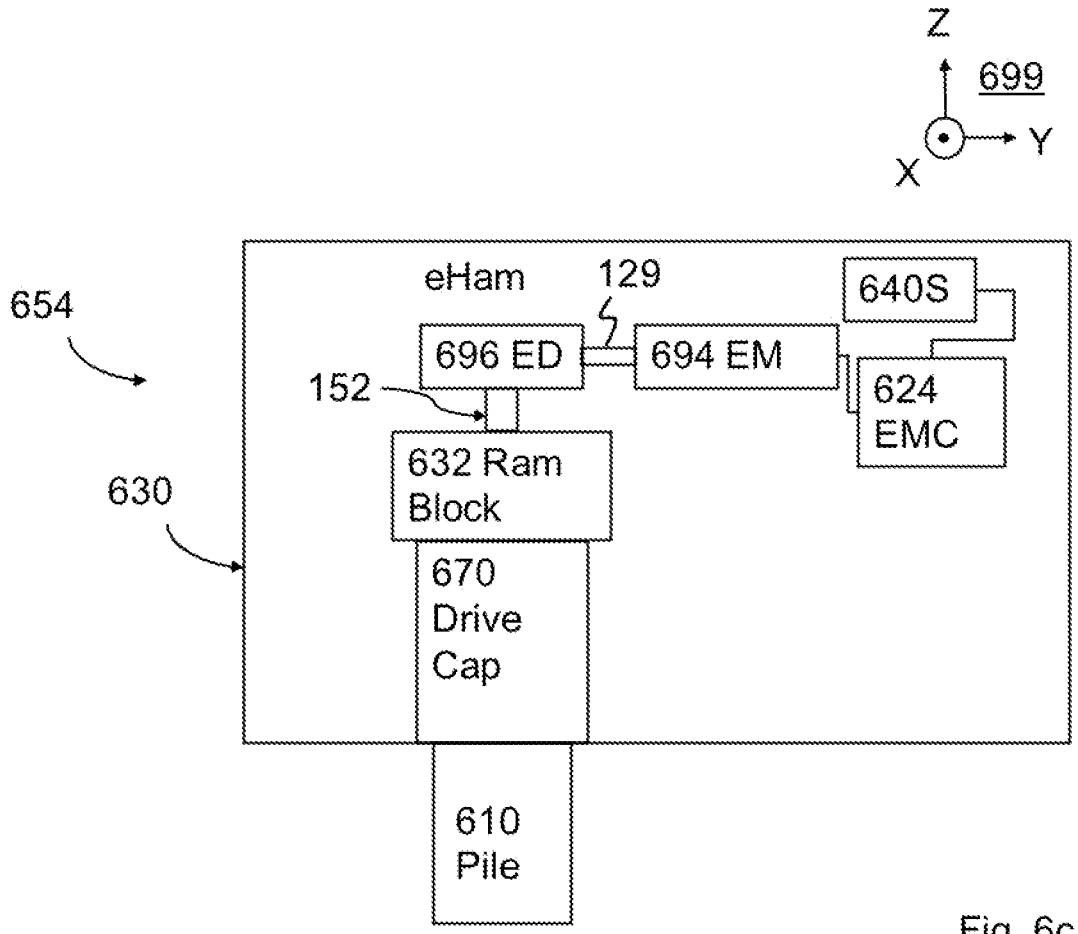

FIGS. 6*a*, 6*b* and 6*c* show block diagrams for hammer devices 650,652,654 according to at least some embodiments. All the hammer devices comprise electric machines. The hammer devices shown in FIGS. 6*a* and 6*b* comprise linear electric machines 690,692 and, with reference to both FIGS. 6*c* and 1*b*, FIG. 6*c* shows an electric machine 694 comprising an output shaft 129 connected to an eccentric drive unit 130 for transforming a rotation of the output shaft into a linear movement of a mover 152 connected to the eccentric drive unit. The hammer devices comprise processors connected to the electric machines 690,692,694. The processor is configured to perform one or more functionalities described in examples herein. The processor may be included in a control device 620,622,624, e.g. an electric motor controller (EMC). The control device may comprise a memory and computer program comprising instructions that, when executed by the processor cause to perform one or more functionalities described in examples herein, e.g. at least for accelerating a mover of the hammer device for striking a pile.

As a difference to the linear electric machine 690 of the hammer device 650, the linear electric machine 692 of the hammer device 652 may be used for regenerative braking and electrical current of the regenerative braking may be stored to an energy storage as controlled by a control device 622 of the hammer device. Accordingly, it should be noted that the linear electric machine 692 of the hammer device 652 may be used at least for decelerating a mover of a hammer device and additionally for accelerating the mover of the hammer device.

The hammer device 650,652,654 in FIGS. 6*a*, 6*b* and 6*c* may be a hammer for a ram pile, or a piling hammer for striking a pile 610, e.g. as described with reference to FIGS. 1 and 2. A piling hammer is a machine used in construction work for driving steel, concrete, or wood piling into the earth by a reciprocating movement of a hammer block. The section plane is parallel with the yz-plane of a coordinate system 699 comprising x, z, and y axes. The hammer device may comprise a frame arrangement 630 that may comprise one or more elements, e.g. guides such as leader guides, for connecting the hammer device to a leader of a pile driving machine. The hammer device 650,652 comprises a linear electric machine 690,692 and a ram block 632 connected to a mover of the linear electric machine. The hammer device 654 comprises an electric machine 694 comprising an output shaft 129 connected to an eccentric drive unit 696 for transforming a rotation of the output shaft into a linear movement of the mover 152 that is connected to the eccentric drive unit and a ram block 632. Therefore, in all the hammer devices 650,652,654 the mover is linearly movable, e.g. movable in the striking direction, by the electric machine. The piling hammer comprises an electric motor controller (EMC), or a control device, 620,622,624 for controlling the linear electric machine 690,692 or the electric machine 694. In an example the EMC may be connected to the linear electric machine 690,692, or the electric machine 694, and/or an external power supply for supplying electric currents to windings of the linear electric machine, or the electric machine 694, for controlling a linear movement of a mover of the linear electric machine, or a linear movement of a mover connected to the eccentric drive unit. The controlling of the linear movement of the mover may comprise accelerating or decelerating the mover. The linear movement may be a reciprocating movement in a direction parallel to the z-axis. Therefore, when connected to the mover, the ram block is linearly movable with the mover, whereby both the mover and the ram block may be moved in the same direction parallel to the z-axis. It should be noted that the z-axis may be a vertical direction on a direction inclined with respect to the vertical direction. The frame arrangement may comprise guides for supporting movement of the ram block and the mover in a direction inclined with respect to the vertical direction.

In an example, the electric motor controller (EMC), or the control device, 620,622,624 may be connected to a power electronic converter, or the power electronic converter may serve as the electric motor controller (EMC), or the control device, 620,622. The power electronic converter may be coupled to the windings of the stator of the linear electric machine 690,692, or the stator of the electric machine 694.

The hammer device 650,652,654 may comprise a drive cap 670 for transferring a striking force from the ram block to a pile for driving the pile by the piling hammer. The drive cap may be constructed within a drive cap housing comprising a drive cap cushion and a rebound ring. The drive cap may have on its lower side a plurality of surfaces against which the pile 610 can fit. When striking the pile, the energy from the ram block striking the drive cap may be transferred to the pile through the drive cap that sits on top of the pile. The mover and therewith the ram block may be engaged in a reciprocating movement for continuously driving the pile by striking the pile by consecutive blows of the ram block. The linear electric machine 690,692 can be for example such as illustrated in any of FIGS. 1*a*, 2, 4*a*-4*c* or FIG. 5.

In an example, the piling hammer 650,652,654 may be configured to determine a position of the mover and/or the ram block 632. The position of the mover and/or the ram block 632 may be determined based on electrical induction, e.g. by the control device 620,622624. The electrical induction may be measured by the control device connected to the LEM and/or one or more sensors 640, e.g. inductive sensors. The control device may measure electrical current induced to the windings of the LEM. Accordingly, a movement of the mover induces electrical currents to the windings, which may be measured by the control device. The windings are arranged to the stator both radially around the mover and axially, parallel to the longitudinal direction of the mover, e.g. parallel to the z-axis, whereby the position of the mover may be determined based on the electrical induction of electrical current to the windings as the mover is moved linearly back and forth through the stator that holds the windings. On the other hand, the one or more sensors 640 may be arranged to the piling hammer 650, 652,654 for detecting a position of the mover and/or the ram block 632. The one or more sensors 640 may be arranged e.g. to the frame arrangement 630, e.g. to detect one or more upper positions and/or one or more lower positions of the mover. Examples of the one or more sensors comprise at least a mechanical position sensor comprising a sensor rod fixed to the mover of the electric machine. The position of the mover can also be measured in a contactless way, for example with a laser measurement arrangement. It is also possible provide the mover and the stator with structures operable as an inductive position sensor. The mover and the ram block may be directly connected to each other, whereby they may be moved as a single entity. Therefore, detecting a position of the mover or the ram block may be used to determine a position of the other. Examples of the detected positions at least a peak position and a position of the pile head. The peak position may be the highest position of the ram block 632 for striking the pile at a total target kinetic energy. After the blow to the pile by the ram block, the pile may advance and the ram block is recoiled upwards, e.g. in a direction parallel to the z-direction. The recoiled ram block is stopped at a new peak position for a subsequent blow to the pile. When the pile is advanced, subsequent peak positions of the ram block may form a decreasing series of peak positions. An advancement of the pile may be determined based on a difference between peak positions of subsequent blows or peak positions between a number of blows.

In an example, the piling hammer 652 may comprise an energy harvesting system 680 for harvesting at least a part of recoiled kinetic energy from striking the pile 610 using a ram block connected to a mover of the linear electric machine 692. The energy harvesting system may comprise an energy storage for example an electrical battery. The energy harvesting system may be connected to the linear electric machine 692 for receiving electrical current from the linear electric machine, when the linear electric machine is performing regenerative braking. When the linear electric machine is performing regenerative braking, the linear electric machine is operating as a generator of electric current for decelerating a movement of the mover. The electrical current from the linear electric machine is stored to the energy storage. The energy harvesting system may be connected to supply electrical current from the energy storage to the linear electric machine, when the linear electric machine is operating as electric motor. In this way the electrical energy stored to the energy storage may be used to accelerate the mover. The control device 622 may be connected to the energy storage and the linear electric machine for controlling the linear electric machine and flow of electric current between the linear electric machine and the energy storage.

The hammer device 650,652,654 may comprise a power supply. The control device may be included to a power supply or the power supply may be an external power supply. When the hammer device is installed to a pile driving apparatus, the power supply may be deployed to the pile driving apparatus. In a similar manner, the energy storage 680 may be built-in to the hammer device or the energy storage may be external to the hammer device. When the hammer device is installed to a pile driving apparatus, the energy storage may be deployed to the pile driving apparatus.

Figure 7:
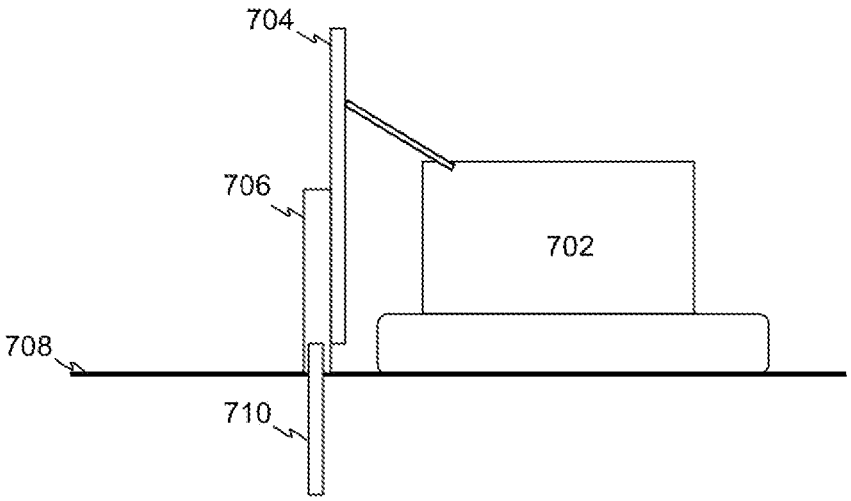
FIG. 7 illustrates an example of a pile driving apparatus according to at least some embodiments.

FIG. 7 illustrates an example of a pile driving apparatus according to at least some embodiments. The pile driving apparatus may comprise a piling hammer described in accordance with an example described herein. The pile driving apparatus 702 comprises a leader 704 and a piling hammer 706 installed to the leader. The leader is an elongated part of the pile driving apparatus, having the function of enabling a movement of the piling hammer in a direction that is transverse or inclined with respect to the ground surface 708 during driving a pile 710 into the ground. The leader may be tilted for driving the pile in a vertical or an inclined position and for tilting the leader to a horizontal position for the time of transport of the pile driving machine.

Figure 8:
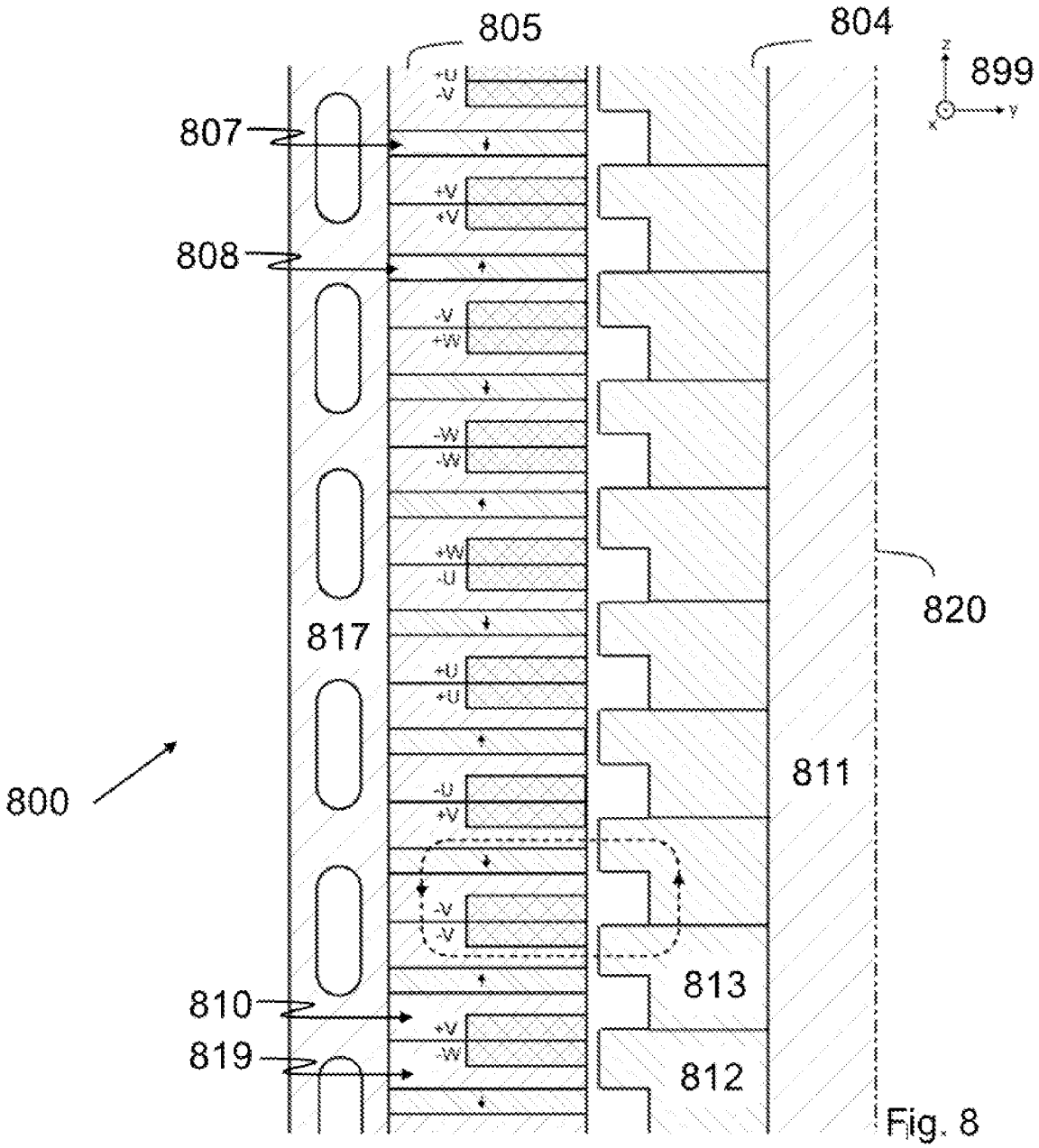
FIG. 8 illustrates an example of a linear electric machine in accordance with at least some embodiments.

FIG. 8 illustrates a part of a linear electric machine in accordance with at least some embodiments. The linear electric machine 800 may be used in the piling hammer 100*a* described with FIG. 1. However, it should be noted that the linear electric machine 800 may also be applied to the linear electric machine described with FIG. 2, where the linear electric machine 800 is formed by the ram block 134 serving as a mover and the frame 122 serving as a stator of the linear electric machine 800.

The linear electric machine 800 comprises a mover 804 and a stator 805. The mover 804 is movably supported relative to the stator 805, the direction of movement of the mover 804 being parallel to the z-axis of a coordinate system 899. FIG. 8 shows a section view in which the section plane is parallel to yz-plane of the coordinate system 899. The stator 805 comprises windings for generating a magnetic force directed to the mover 804 in response to electric current supplied to the windings. In the exemplifying case shown in FIG. 8, the windings constitute a three-phase winding whose phases are denoted with figure references U, V and W. The linear electric machine is a tubular linear electric machine in which the conductor coils of the stator windings are arranged to surround the mover 804. The mover 804 and the electromagnetically active parts of the stator 805 can be, for instance, rotationally symmetric with respect to a geometric line 820 shown in FIG. 8. In FIG. 8, the cross-sections of the conductor coils of the windings of the stator 805 are presented as cross-hatched areas. FIG. 8 uses a notation in which the left side of an area representing a cross-section of each conductor coil is provided with a phase-indicating figure reference U, V or W, and with "+" if the direction of electric current in the conductor coil cross-section under consideration is the positive x-direction of the coordinate system 899 when the electric current of this phase U, V or W is positive, or with "−" if the direction of the electric current in the conductor coil cross-section under consideration is the negative x-direction of the coordinate system 899 when the electric current of this phase U, V or W is positive. The stator 805 has annular permanent magnets provided one after another in the longitudinal direction of the mover 804, wherein the axial direction of the annular shape of each permanent magnet coincides with the longitudinal direction of the mover, i.e. is parallel with the z-axis of the coordinate system 899. In FIG. 8, two of the annular permanent magnets are denoted with figure references 807 and 808. The magnetizing directions of the permanent magnets coincide with the longitudinal direction of the mover 804, the magnetizing directions of the successive permanent magnets being opposite to each other. The magnetizing directions of the permanent magnets are indicated with arrows in FIG. 8. An exemplifying magnetic flux line is depicted with a dashed line. The core structure of the stator 805 comprises annular ferromagnetic elements surrounding the mover 804 and forming slots for the conductor coils of the windings. In FIG. 8, two of the annular ferromagnetic elements are denoted with figure references 809 and 810. The annular ferromagnetic elements and the permanent magnets of the stator are provided in the longitudinal direction of the mover 804 so that there is one of the slots between successive permanent magnets. In this exemplifying case, two conductor coils are provided in each stator slot. For example, conductor coils with designations +V and −W are provided in the slot formed by the ferromagnetic elements 809 and 810. The stator 805 may also comprise a stator frame 817, possibly equipped with cooling channels for a cooling medium flow. The stator frame 817 is advantageously made of a non-ferromagnetic material to allow a portion as large possible of the magnetic flux generated by the permanent magnets to travel through the mover 804. The stator frame 817 can be made of for example aluminum.

The mover 804 has a center rod 811 and annular ferromagnetic elements provided around the center rod to form a ferromagnetic core structure of the mover. In FIG. 8, two of the annular ferromagnetic elements of the mover are denoted with figure references 812 and 813. The annular elements of the mover 804 are shaped to form, on the outer surface of the mover, ridges oriented in the circumferential direction of the mover and causing a reluctance variation which enables the stator 805 to generate the magnetic force directed to the mover. FIG. 8 only shows a portion of the linear electric machine concerned. In total, the slots of the stator 805 can be for example 12 in number, for example, and the ridges can be provided on the mover 804 so that there are for example 13 mover ridges in the area covered by the stator. The mover 804 must have such a length that there is a sufficient number of ridges in the area covered by the stator within the entire range of movement of the mover. It should be noted that, the number of slots and ridges as well as the length of the mover may adapted according to implementation so as to accelerate a ram block from an upper position to a lower position, where potential energy is transformed into kinetic energy and the ram block strikes a drive cap.

The linear electric machine illustrated in FIG. 8, having permanent magnets on its stator, is often referred to by the term a Flux switching permanent magnet synchronous machine, abbreviated as "FSPMSM".

It should be noted that an electric machine for a ram block arrangement and piling hammer in accordance with at least some embodiments may be implemented in various ways. For example, the electric machine may be a linear electric machine and formed by a ram block serving as a mover and a frame serving as a stator of the linear electric machine in accordance with FIG. 2. On the other hand, the linear electric machine may have a stator and a mover connected by a connector to the ram block in accordance with FIG. 1. Depending on the implementation of the linear electric machine, the mover or the ram block serving as the mover may be provided with permanent magnets of the permanent magnets may be omitted. In the latter case the permanent magnets may be provided at the frame or included to the frame of the ram block together with stator windings and ferromagnetic elements. Accordingly, the frame of the ram block arrangement may be a stator frame, a stator frame may be connected to the frame of the ram block arrangement. In the latter case, the stator frame may be connected inside the frame of the ram block arrangement, whereby it is protected by the frame of the ram block arrangement and efficient travel of the magnetic flux generated by the permanent magnets through the ram block serving as the mover may be supported.

It is to be understood that the embodiments disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to one embodiment or an embodiment means that a particular feature, structure, or characteristic described in connection with the embodiment is included in at least one embodiment. Thus, appearances of the phrases "in/according to one embodiment" or "in/according to an embodiment" in various places throughout this specification are not necessarily all referring to the same embodiment. Where reference is made to a numerical value using a term such as, for example, about or substantially, the exact numerical value is also disclosed.

As used herein, a plurality of items, structural elements, compositional elements, and/or materials may be presented in a common list for convenience.

However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and examples may be referred to herein along with alternatives for the various components thereof. It is understood that such embodiments, examples, and alternatives are not to be construed as de facto equivalents of one another, but are to be considered as separate and autonomous representations.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended examples. However, all such and similar modifications of the teachings of this invention will still fall within the scope of this invention.

The invention claimed is:

1. A ram block arrangement for a piling hammer, comprising:

a ram block comprising a frame arrangement for enclosing one or more ram weights therein, wherein the ram block is configured movable by an electric machine;

a connector configured to connect the ram block to a mover of the electric machine or to a mover connected to the electric machine by an eccentric drive unit, wherein the connector comprises a collar portion adapted to a diameter of the mover for connecting the collar portion around a circumference of the mover; and wherein the connector has a base portion configured to connect with the frame arrangement and an intermediate portion for connecting the collar portion and the base portion together.

2. The ram block arrangement according to claim 1, wherein the collar portion comprises a flange for connecting with the intermediate portion.

3. The ram block arrangement according to claim 1, wherein the base portion comprises a lifting lug and the intermediate portion comprises a lifting eye connectable with the lifting lug by a pin.

4. The ram block arrangement according to claim 3, wherein the frame arrangement comprises ferromagnetic core-elements that are alternately with the permanent magnets in the striking direction of the piling hammer.

5. The ram block arrangement according to claim 1, wherein the frame arrangement comprises permanent magnets provided one after another in a striking direction of the piling hammer.

6. The ram block arrangement according to claim 5, wherein neighboring permanent magnets in the striking direction have opposite magnetization directions.

7. A piling hammer wherein the piling hammer comprises the electric machine connected to the ram block of the ram block arrangement according to claim 1 for driving the ram block.

8. The piling hammer of claim 7, wherein the electric machine is a linear electric machine for generating a magnetic force directed to the mover, or the electric machine has an output shaft for providing a torque and the piling hammer comprises an eccentric drive unit connected to the output shaft and the mover for transforming a rotation of the output shaft into a linear movement of the mover.

9. A pile driving apparatus wherein the pile driving apparatus comprises the piling hammer according to claim 7 installed to a leader.

10. A piling hammer comprising a frame wherein the frame houses the ram block arrangement according to claim 1, wherein the frame comprises windings for producing a magnetic force directed to the ram block in response to electric current supplied to the windings for causing a linear movement of the ram block.

11. A pile driving apparatus wherein the pile driving apparatus comprises the piling hammer according to claim 10 installed to a leader.

* * * * *